United States Patent [19]

Langdon

[11] 4,238,126

[45] Dec. 9, 1980

[54] RECIRCULATING SIMPLEX/DUPLEX DOCUMENT HANDLER

[75] Inventor: Michael J. Langdon, Fairport, N.Y.

[73] Assignee: Xerox Corporation, Stamford, Conn.

[21] Appl. No.: 71,643

[22] Filed: Aug. 31, 1979

[51] Int. Cl.[3] ..... B65H 1/06; B65H 3/04

[52] U.S. Cl. ..... 271/3.1; 271/DIG. 9; 271/65

[58] Field of Search ..... 271/DIG. 9, 3.1, 4, 271/65, 185, 186, 225

[56] References Cited

U.S. PATENT DOCUMENTS

| | | | |
|---|---|---|---|
| 3,856,295 | 12/1974 | Looney | 271/65 |
| 4,066,252 | 1/1978 | Wick | 271/65 |
| 4,158,886 | 6/1979 | Gray, Jr. et al. . | |
| 4,166,614 | 9/1979 | Hamlin et al. | 271/3.1 |

*Primary Examiner*—Robert W. Saifer

*Attorney, Agent, or Firm*—William A. Henry, II

[57] ABSTRACT

A recirculating document handler for simplex or duplex copying that is adapted to a fixed platen copier includes an oval shaped document path that is folded over the platen for duplex copying. For simplex copying, a second document path disects the duplex path diagonally. A reversing cavity extends from one end of the platen and is adapted to receive a document during simplex copying and return the document with the use of reversible rollers along the diagonal path to the original feed position. A deflector directs documents to either the duplex or simplex paths depending on operator console selections.

5 Claims, 2 Drawing Figures

RECIRCULATING SIMPLEX/DUPLEX DOCUMENT HANDLER

Figure 1:
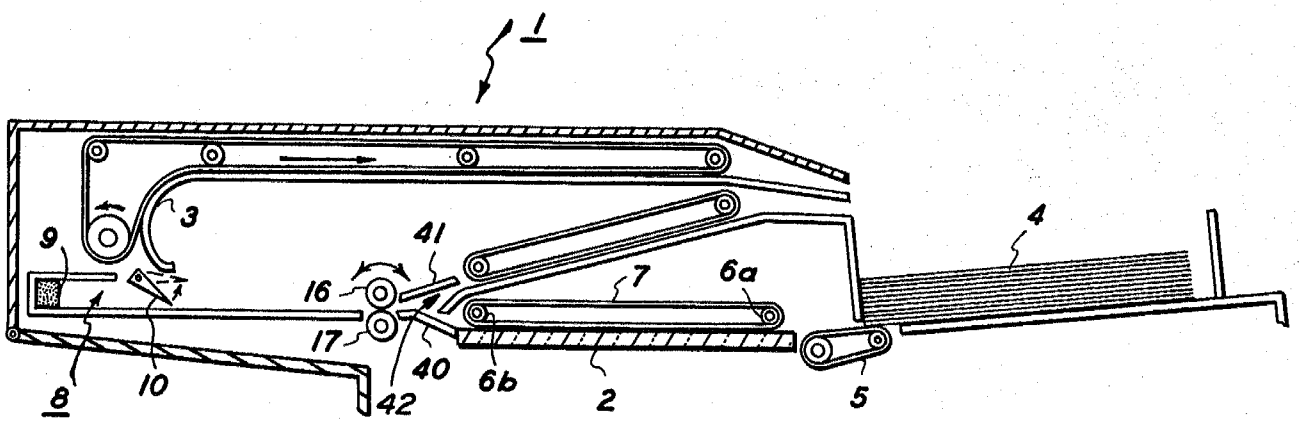

The present invention relates to an automatic document handling apparatus having an improved document recirculation system that allows pre-collation copying of either simplex or duplex documents.

As xerographic and other copiers increase in speed and become more automatic, it is increasingly important to provide higher speed yet more reliable and more automatic handling of both the copy sheets and the individual original documents being copied. The providing of duplex copying capabilities and pre-collation copying capabilities greatly complicates and increases the copier document and copy sheet handling complexities.

While the present invention is not limited thereto, a desirable feature for a copier is to provide automatic document recirculation for pre-collation copying. As discussed, for example, in detail in U.S. Pat. Nos. 3,963,345, issued June 15, 1976 to D. J. Stemmle et al. at columns 1–4, and 4,116,558, issued Sept. 26, 1978 to J. A. Adamek et al., such pre-collation copying systems provide a number of important advantages. The copies exit the copier in pre-collated sets, and do not require subsequent sorting in a sorter or collator. Any desired number of such copy sets may be made by making a corresponding number of recirculations of the document set in collated order past a copying station and copying each document one each time it recirculates. On-line finishing and/or removal of the completed copy sets may be provided while additional copy sets are being made from the same document set.

However, a disadvantage of pre-collation copying systems is that the documents must all be repeatedly circulated, and copied in a predetermined order only one in each circulation, by a number of circulations equivalent to the desired number of copy sets. Thus, it may be seen that increased document handling is necessitated for a pre-collation copying system, as compared to a conventional post-collation copying system. Maximizing document handling automation and copying cycle efficiency is particularly important in pre-collation copying. If the document handler cannot circulate and copy documents in corrdination with the copy sheets in the correct order, the total copying time for each copy set will be increased.

In a post-collation copying system, all the desired copies are made at one time from each document page and collated by being placed in separate sorter bins. The document set need only be circulated once and multiply copied to fill bins of the copy sheet sorter or collator with the corresponding number of copy sets desired. However, the number of copy sets which can be made in one circulation is limited by the number of available bins, and the sorter adds space and complexity and is not well suited for on-line finishing.

Some examples of art relating to pre-collation document handling units include, besides art cited above: German Patentschrift No. 1,128,295, Oct. 25, 1962; and U.S. Pat. No. Re. 27,976 (originally U.S. Pat. No. 3,499,710, issued Mar. 10, 1970) to L. W. Sahley; U.S. Pat. No. 3,536,320, issued Oct. 27, 1970, to D. R. Derby; U.S. Pat. No. 3,552,739, issued Jan. 5, 1971, to R. R. Roberts et al.; U.S. Pat. No. 3,556,511, issued Jan. 19, 1971, to A. Howard et al.; U.S. Pat. No. 3,888,579, issued June 10, 1975, to V. Rodek et al.; and U.S. Pat. No. 3,937,454, issued Feb. 10, 1976, to R. H. Colwill. A recent example of a recirculating pre-collation copying system of this type with circuitry and switches for counting the number of documents recirculated and for counting the completion of each set circulation, is shown in U.S. Pat. No. 4,076,408, issued Feb. 28, 1978, to M. R. Reid et al.

As to some examples of further art relating to features of this disclosure, U.S. Pat. No. 3,790,158, issued Feb. 5, 1974, to J. E. Summers et al., and several of the above patents disclose recirculating documents to and from a stack at one side of a platen to a fixed registration edge with a reversible platen belt. A sheet reversing chute system of the type disclosed herein is disclosed in U.S. Pat. No. 3,856,295, issued Dec. 24, 1974, to John H. Looney. Another method of reversing sheets is disclosed in U.S. Pat. No. 4,159,824 issued July 3, 1979 to Klaus K. Stange et al.

Examples of copier systems with general document and sheet handling control systems are described in U.S. Pat. Nos. 4,062,061, issued Dec. 6, 1977, to P. J. Batchelor et al.; 4,078,787, issued Mar. 14, 1978, to L. E. Burlew et al.; 4,099,150, issued July 4, 1978, to J. L. Conin; 4,123,155, issued Oct. 31, 1978, to W. L. Hubert; 4,125,325, issued Nov. 14, 1978, to P. J. Batchelor et al.; and 4,144,550, issued Mar. 13, 1979, to J. M. Donohue et al.

Conventional integral software incorporation into the copier's general microprocessor logic circuitry and software of the functions and logic defined herein as taught by various of the above-cited patents is preferred. However, it will be appreciated that the functions and systems disclosed herein may be alternatively conventionally incorporated into a copier utilizing any other suitable or known copier software or hard wired logic systems, cambank switch controllers, etc. The output control of the exemplary sheet handling systems disclosed herein may be accomplished by activating known electrical solenoid controlled sheet deflector fingers and drive motors or their clutches in the indicated sequences, and conventional sheet path sensors or switches may be utilized for counting and keeping track of the positions of documents and copy sheets.

All of the patents cited herein for background or art purposes are also incorporated by reference herein to the extent they provide teachings of usable or alternative systems or hardware for the disclosed embodiments herein.

Some document handlers are of particular importance with respect to the present invention, as for example, U.S. Pat. No. 4,158,886, issued June 19, 1979 to Gerald A. Gray, Jr. et al., which shows in FIG. 14 a post-collation document handler that uses an inclined document return path, and U.S. Pat. No. 2,472,931 issued to F. C. Yohn on June 14, 1949, allows for duplex copying of a document by means of a slit scan exposure device wherein a document is retained upon a drum for movement past the scanning slot after which it is stripped therefrom into a reversing envelope and refed to the drum for copying the reverse side. Another example, is U.S. Pat. No. 3,844,654, which discloses an automatic document handler having provisions for duplex copying with slit scan exposure wherein the document is first fed across a first scanning slit for exposure on one side thereof, after which the document is fed around a drum, which is also provided with a slit scan exposure area for exposing the opposite side of the document. These document handlers have their own advantages and disadvantages. Some are not small and compact but are efficient while others that are efficient take up too much office space and are too complicated for casual operator use when simplex/duplex or duplex/duplex copying is required. A preferred embodiment of the present invention is intended to overcome the above disadvantages by providing in a copier having a fixed platen and an improved recirculating document handler for simplex or duplex copying comprising a first oval shaped document path folded over the platen for copying duplex documents, a second document path for simplex copying that disects the first document path diagonally, chute means that extends from adjacent one end of the platen while being adapted to receive a document during simplex copying and return the document along the diagonal path to an original feed position, and dual mode actuator means for selecting either the first or second paths depending upon whether simplex or duplex copying is required.

Figure 2:
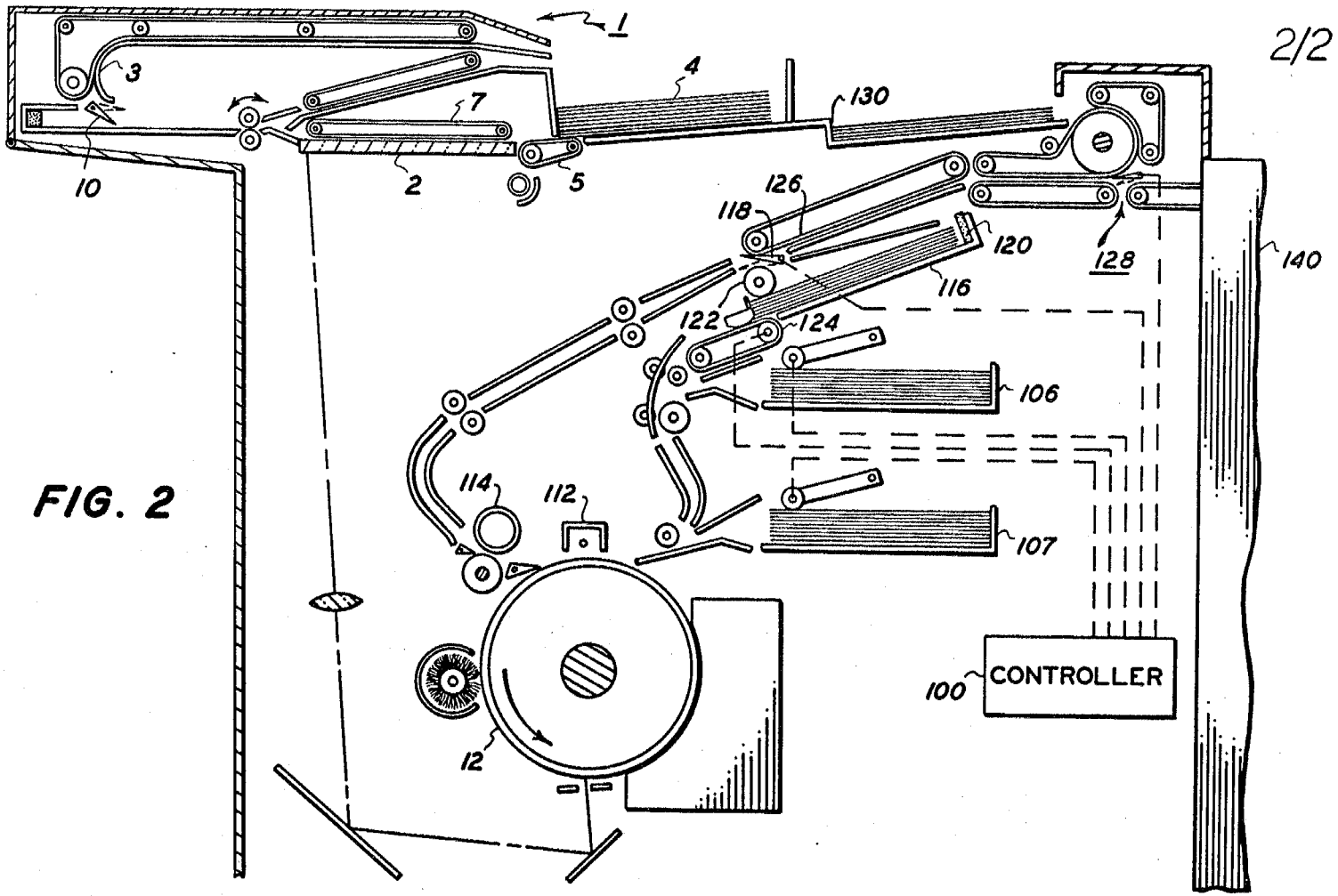

Further features and advantages of the invention will be better understood by reference to the following description, and to the drawings forming a part thereof, wherein:

FIG. 1 is a side view of the recirculating document handling unit of the present invention mounted over a copier platen; and FIG. 2 shows the document handling unit of FIG. 1 on an exemplary duplex xerographic copier.

Referring to the exemplary automatic document feeding unit 1 shown in FIGS. 1 and 2, it will be appreciated that various document feeders and copiers may be utilized with the present invention other than those disclosed herein, including various ones disclosed in the above-cited references.

In the recirculating document handler (RDH) 1 here, individual original documents are sequentially fed from the bottom of the stack of documents 4 (placed by the operator face-down in the document storage area or stacking tray) directly to the imaging station, which is the conventional platen 2 of the copier, to be conventionally imaged onto a photoreceptor for the making of copies in a conventional xerographic manner. The documents are thus circulated in 1 to N order, i.e., first to last or forward serial order, for simplified copy duplexing and job recovery. The document handler 1 has conventional switches for sensing and counting the individual documents fed from the stack 4, i.e., counting the number of document sheets circulated. A conventional resettable bail and its associated switch will be provided on the stack 4 to indicate the completion of each circulation of the complete document set and be automatically reset on the top of the stack before the next circulation. The document sheets may be conventional sizes and weights of sheets of paper or plastic containing information indicia to be copied, e.g., printed or typed letters, drawings, prints, photographs, etc. A bottom feeder 5 feeds the bottom document sheet, on demand, to a platen sheet transport belt 7 entrained over drive roller **6*a* and idler roller 6*b* which moves the document onto and off the copier platen. With this document feeder unit 1, the documents are not inverted as they are fed from the tray to the imaging station. They are selectively inverted, if inversion is desired, by an inverter 3 in the return path of the document from the platen to the stack 4 after copying. The inverter 3** provides for inverting duplex documents so that their opposite sides may be copied.

Referring particularly to FIG. 1, the document sheets to be copied are fed individually from the stack 4 by a bottom feeder 5, both of which are closely adjacent one side of the platen 2. Each document is fed onto the platen here by belt 7 which is directly driven by engagement with roller **6*a* and driven in the arrow direction as shown. The registration of the document on the platen could be accomplished here by registration fingers as disclosed in U.S. Pat. No. 3,844,552 issued Oct. 29, 1974 to C. D. Bleau et al. which patent is incorporated herein by reference. Belt 7 drives the document after copying toward the nip formed between reversible roller 16 and idler roller 17, which transports the document into a diverter gate 10**.

If the lip of the gate 10 is up as shown in dotted lines in FIG. 1, the document will travel by the urging of reversible roller 16 into reversing chute or cavity 8 until it strikes a resilient reversing pad 9 of a known type at the end thereof, which bounces the document back into the nip between the rollers 16 and 17 which drive the document past pointed guide 40 and guide 41 along inclined path 42 that disects the duplex return path and the plane of platen 2. Inclined path 42 directs the document into the top of stack 4 in a feed tray so that the documents may be recirculated in maintained collated order without inversion. Thus, in this mode of operation, used for simplex documents, the document inversion ramp 3 is not utilized.

For duplex documents the gate 10 is held down, as shown in solid lines in FIG. 1, in order to deflect the documents directly into inverter ramp 3 which will return the documents directly to the top of stack 4 in inverted form for recirculation and copying of the reverse side of the documents.

Note that the RDH here is small and compact with a top that is pivotable for jam clearance purposes. The unique size is due to the folded oval shaped inverter path for duplexing and the compact simplex copying path that disects paths formed by the duplex path and the horizontal plane of platen 2. A small reversing cavity 8 is included in the same horizontal plane as the platen for use in conjunction with dual function reversible roller 16, while functions during simplex copying to forward documents into reversing cavity 8 in one direction and subsequently reverse direction and forwards the document along inclined path 42 toward document stack 4. During duplex copying reversible roller 16 forwards documents towards inverter ramp 3 in one direction only. With this RDH 1, the first document page in stack 4 may be copied immediately in every circulation, and the entire document recirculation path is very short, thus desirably reducing the movement velocity of the documents needed to keep up with the copying rate of the copier. The simplex document path is shorter than the duplex path, which is preferable since that is the more commonly used mode.

To restate the above, and in accordance with the present invention, a recirculating document handler 1 for simplex or duplex copying includes a reversing cavity 8 for simplex copying and an inverting ramp 3 for automatic duplex copying for duplexed original documents. In the simplex mode, documents reverse direction in reversing cavity 8 and are fed along an inclined path back to an input tray which holds documents 4 for automatic recirculation. For duplex copying, the original documents are fed from stack 4 over the exposure station 2 and forward by reversible drive roller 16 and roller 17 into two-position gate 10 which has been actuated into its intercept position. The ramp 3 inverts the documents before returning them to the input tray and thereby readies them for copying the opposite side.

Both the simplex transport path and duplex transport path continuously and rapidly restack the sheets after they are copied on the top of the stack 4 of the sheets in the document tray without interferring with simultaneous bottom feeding. Thus, continuous multiple recirculations for pre-collation copying can be provided.

Referring to FIG. 2, and exemplary copier processor 20 and its controller 100 will now be described. This copier system is disclosed in more detail in U.S. Pat. No. 4,166,614, issued Sept. 4, 1979 to Thomas G. Hamlin et al and German OLS No. 2,828,669. It provides duplex or simplex pre-collated copy sets from either duplex or simplex original documents copied from the RDH 1. Two separate copy sheet trays 106 and 107 are provided here to feed clean copy sheets onto which the images of the documents are to be printed. The control of sheet feeding is by the machine controller 100. The controller 100 is preferably of the known programmable microprocessor type exemplified by the patents cited in the introduction, which conventionally also controls all of the other machine functions described herein including the operation of the document feeder.

The copy sheets are fed from trays 106 or 107 to the conventional xerographic transfer station 112 for imaging one side thereof, then to the conventional fusing station 114. From there, depending on the position of a duplex selector finger or gate 118, the copy sheets will be deflected either into a duplex buffer intermediate storage tray 116 for duplex copies, or into the copy output path of the copier via an output transport 126. The copy sheets stacked into the duplex tray 116 are stacked image face-up in the order in which they were copied. The duplex tray 116 here includes a bounce reverser 120 and jogger/normal force wheels 122 for assisting the stacking of copy sheets therein and assistance in bottom feeding from the duplex tray 116 by a bottom feeder 124. For duplex copying the previously simplexed copy sheets in the tray 116 are fed by the feeder 124 back to the transfer station 112 for the imaging of their second or opposite side page image. Such now-duplexed copy sheets are then fed out past the now-opened gate 118 into the same output transport 126.

The output transport 126 transports the finished copy sheets to an output tray 130 through a gate 128 and inverter as shown, or, preferably, to a finishing station 140 for the stapling, stitching, gluing, binding, and/or off-set stacking of the completed, pre-collated, copy sets. The copy sheets may be stacked in an output tray or in the finisher in a compilier tray in the order produced, without inversion for simplex copies, or with an inverter, or inversion in the output path, for duplex copies, in this 1 to N system, in which the odd page side is the second side imaged and the copies are inverted inherently by the processor before the output.

As disclosed in the cited U.S. Pat. No. 4,116,558, preferably for simplex/duplex copying only the even page documents are copied in the first document circulation by copying every other document sheet starting with the second document sheet. The odd document pages are circulated, but not copied in this first circulation. Thus, an even side buffer set is preferably always placed in the duplex tray. After the first document circulation, all by the last subsequent circulations proceed with copying of all simplex document pages in each circulation onto copy sheets fed alternately from the copy tray and duplex tray. Then on the last document set circulation only the odd document pages are copied.

Referring now to the duplex/duplex system which can be compatibly provided here, the duplex documents may also be loaded face-down and copied in the same 1 to N (forward serial) order from the same single document tray. Here the document inverter for the duplex documents is downstream of the platen rather than upstream. Thus, the duplex documents may be first run through a single dummy (non-copying) circulation with inversion to restack the documents inverted in the DH tray from their initial orientation. Thus, the even sides of the duplex documents may be copied on the second (first copying) circulation. On all subsequent circulations (up to the final one) every duplex document sheet is copied on one side and then inverted before restacking as described in U.S. Pat. No. 4,166,614, issued Sept. 4, 1979 to Thomas G. Hamlin et al and OLS No. 2,828,669. That is, all the even document page sides may be copied on one circulation and placed in the duplex tray, then all the odd sides copied in the next circulation onto the opposite sides of that buffer set fed from the duplex tray, etc. The duplex documents are inverted during all but the last circulation. On the last duplex document copying pass the documents are all copied but are not inverted. Therefore, they are automatically re-collated in the document handler tray during this last copying circulation.

Alternatively, the 1–N dummy RDH cycle could be eliminated by transporting the sheets to an output tray adjacent gate 128 that would not invert the copies. Also, the dummy RDH cycle could be eliminated by inverting each copy before transport into tray 130.

The disclosed document handling unit is particularly suitable for alternatively or additionally providing a non-pre-collation copying mode in which multiple copies are made from the documents and they are not recirculated. The documents can be placed in the same manner (face-down) in a stack, or manually fed one at a time face-down like a semi-automatic document handler. That is, the same, logical, document placement is provided for all copying modes.

As can be seen from the above description, there is disclosed herein a recirculating document handler for simplex or duplex copying that includes an oval shaped duplex document path and a simplex document path that disects diagonally the area formed between the duplex copying path and a platen exposure position. A reversing cavity is used during simplex copying for changing the direction of document movement and directing documents toward the diagonal path for return to the original feeding position for recirculation.

In addition to the method and apparatus disclosed above, other modifications and/or additions will readily appear to those skilled in the art upon reading this disclosure and these are intended to be encompassed within the invention disclosed and claimed herein.

What is claimed is:

1. In a copier having a fixed platen and a recirculating document handler for simplex or duplex copying, the improvement comprising:

a first oval shaped document path folded over the platen for copying duplex documents;

a second document path for simplex copying that disects said first document path diagonally;

chute means extending from adjacent one end of the platen and adapted to receive a document during simplex copying and return the document along said diagonal path to an original feed position; and dual mode actuator means for selecting either said first or second paths depending upon whether simplex or duplex copying is required.

2. The improvement of claim 1 wherein said chute means functions as a reversing means for said simplex copying.

3. The improvement of claim 2 wherein said chute means extends from one side of and in the same general plane as said platen.

4. The improvement of claim 3 including reversible rollers located at the entrance of said chute means.

5. The improvement of claim 4 wherein said dual mode actuator means comprises a deflector gate within said chute means to deflect documents away from said chute means into said duplex path.

* * * * *